US005315107A

United States Patent [19]

Smith et al.

[11] Patent Number: 5,315,107

[45] Date of Patent: May 24, 1994

[54] COMPACT DISC COUNTER ARRANGED TO MINIMIZE COUNTING ERRORS HAVING A PAIR OF BEAMS AND A PULSE COUNTING MEANS

[75] Inventors: Scott Smith, Scranton; Anthony Pietrzykoski, Plains; Floyd Goss, Lake Ariel, all of Pa.

[73] Assignee: WEA Manufacturing Inc., Olyphant, Pa.

[21] Appl. No.: 52,171

[22] Filed: Apr. 23, 1993

[51] Int. Cl.[5] ..... H01J 40/14

[52] U.S. Cl. ..... 250/222.2; 250/561

[58] Field of Search ..... 250/222.2, 222.1, 561; 377/8; 414/DIG. 2–DIG. 4, 331

[56] References Cited

U.S. PATENT DOCUMENTS

| | | | |
|---|---|---|---|
| 3,936,878 | 2/1976 | Chrysler | 360/98 |
| 4,803,373 | 2/1989 | Imamura et al. | 250/561 |
| 4,994,666 | 2/1991 | Higgison et al. | 250/222.2 |
| 5,032,715 | 7/1991 | DeLise | 250/222.2 |
| 5,040,196 | 8/1991 | Woodward | 377/8 |

*Primary Examiner*—David C. Nelms
*Assistant Examiner*—Que T. Le
*Attorney, Agent, or Firm*—Shenier & O'Connor

[57] ABSTRACT

Apparatus for counting compact discs stacked on a spindle with outer portions of adjacent discs normally separated by gaps formed by central bosses of the discs in which the stack is moved vertically through the space between transmitting optics which produce a pair of vertically spaced beams having a space therebetween equal to the distance between a pair of adjacent gaps of the stack and receiving optics including a detector which produces pulses in response to radiation from said beams which transverse the gaps. The time between a pair of successive pulses is measured and the second pulse of the pair is counted as two pulses when the measured time exceeds a predetermined time. The apparatus is arranged to operate with either of two types of spindles.

20 Claims, 9 Drawing Sheets

COMPACT DISC COUNTER ARRANGED TO MINIMIZE COUNTING ERRORS HAVING A PAIR OF BEAMS AND A PULSE COUNTING MEANS

FIELD OF THE INVENTION

The nvention is in the field of counters and, more particularly, relates to a device for counting compact discs on a spindle.

BACKGROUND OF THE INVENTION

As is known in the art, compact discs (CDs) are formed with a central opening and with a boss surrounding the opening on one side of the disc. Normally, in the course of manufacture of the discs, a number of discs are placed on a spindle with the bosses forming spaces between adjacent discs outside the bosses. Obviously, it is desirable to know the number of discs carried by the spindle.

Higgison et al U.S. Pat. No. 4,994,666 shows a device for counting compound discs stacked on a spindle by means of a laser beam which traverses the spaces between adjacent discs of the stack. More specifically, a base supports a laser, the beam of which is translated to a lens system supported on a platform. The platform is driven by a lead screw to cause the beam to scan a stack of discs. A detector supported by the platform and disposed on the opposite side of the stack from the transmitting optics produces a signal each time the laser beam traverses the space between a pair of adjacent discs, thus to produce a count of the number of discs in a stack.

While the Higgison et al device is generally satisfactory, it embodies a number of defects. First, owing to the fact that it employs movable optics, the system is relatively complex and cumbersome. Secondly, it involves the possibility of missing a count because a pair of adjacent discs have no space therebetween. This may result from production defects or from the fact that not all discs are stacked with their bosses facing the same way.

SUMMARY OF THE INVENTION

One object of our invention is to provide a compact disc counter which overcomes the disadvantages of compact disc counters of the prior art.

Another object of our invention is to provide a compact disc counter which is relatively simple in construction and in operation.

A further object of our invention is to provide a compact disc counter in which the possibility of missing a count is minimized.

Yet another object of our invention is to provide a compact disc counter which readily accommodates different types of spindles.

Other and further objects of our invention will appear from the following description.

BRIEF DESCRIPTION OF THE DRAWINGS

In the accompanying drawings to which reference is made in the instant specification and which are to be read in conjunction therewith and in which like reference characters are used to identify like parts in the various views.

DESCRIPTION OF THE PREFERRED EMBODIMENT

Figure 1:
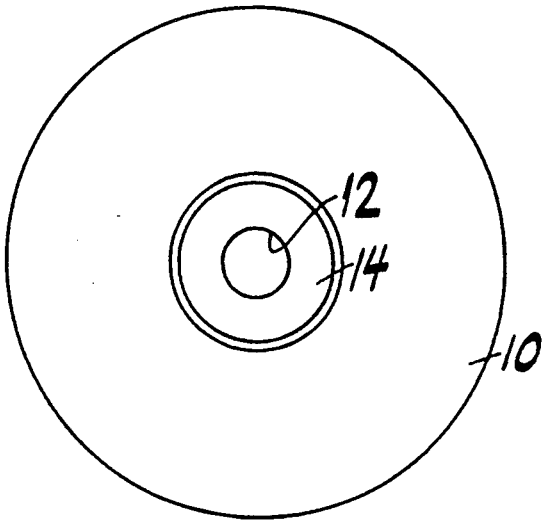
FIG. 1 is a plan of a compact disc showing the central boss thereof.
Figure 2:
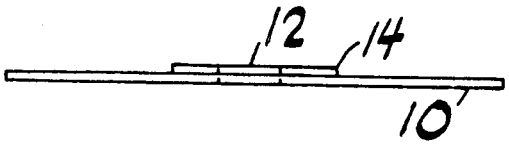
FIG. 2 is an elevation of the disc shown in FIG. 1.

Referring now to FIGS. 1 and 2, a compact disc 10 is formed with a central opening 12 and with a boss 14 extending around the opening on one side of the disc. As will be pointed out more fully hereinbelow, in handling a number of compact discs 10, normally they are stacked on a spindle with the bosses 14 all facing in the same direction.

Figure 3:
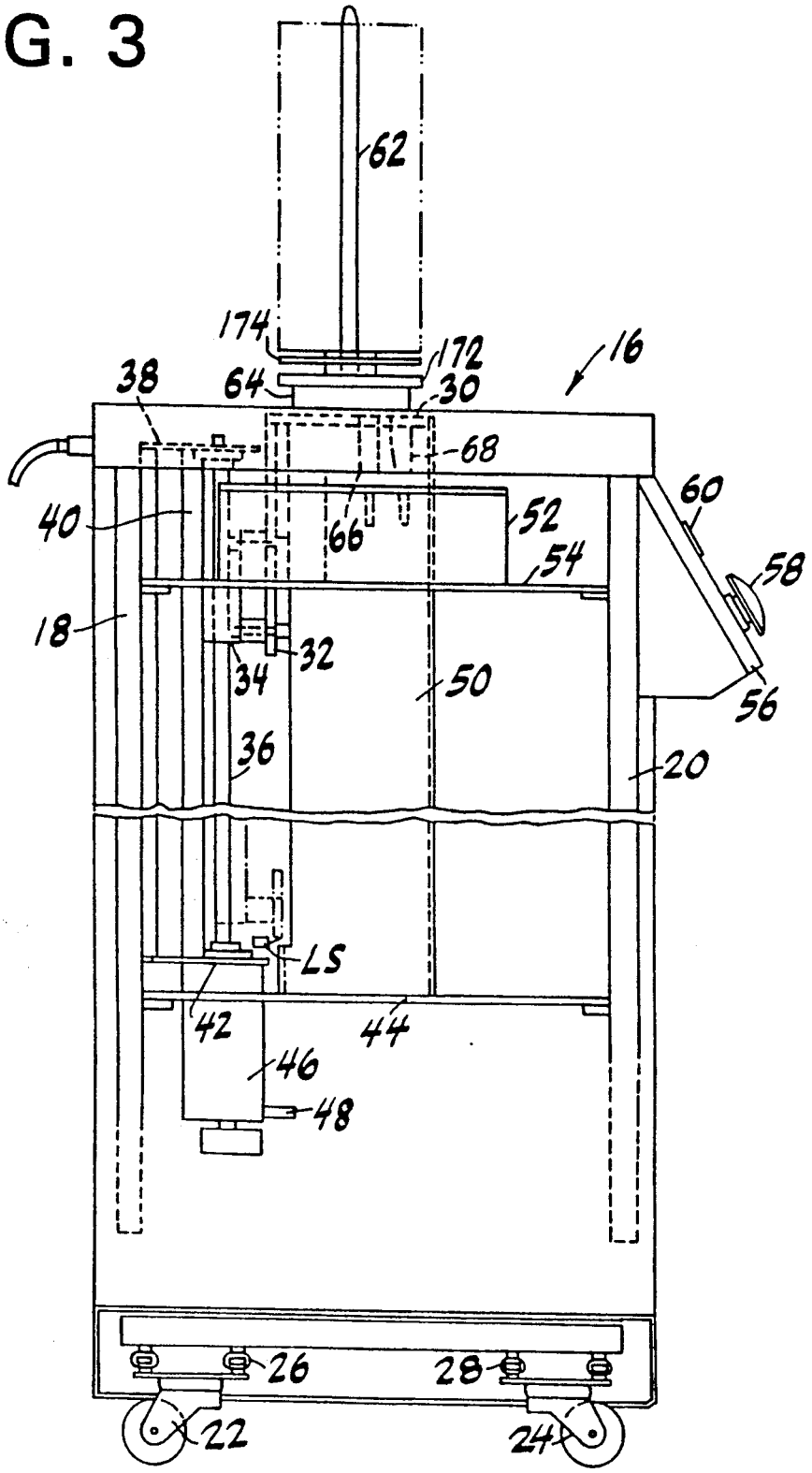
FIG. 3 is a side elevation of our compact disc counter with a part broken away.

Referring now to FIG. 3, our compact disc counter indicated generally by the reference character 16, has a frame including a plurality of spaced uprights including uprights 18 and 20 which support various components of the device in a manner to be described.

A plurality of casters including casters 22 and 24, support the counter 16 through the medium of shock absorbing mountings 26 and 28.

Our counter 16 includes a spindle support table 30 carried by a bracket 32 connected to a ball nut 34 adapted to be driven by a lead screw 36. Respective upper and lower brackets 38 and 42 connected by a vertical 40 support the lead screw 36.

Stepper motor support plate 42 is connected to the vertical support 40 which is supported by the uprights 18 and 20. Plate 42 carries a stepper motor 46 which is adapted to be energized through conductors 48. As will be explained more fully hereinbelow, motor 46 is adapted to be energized to drive the table 30 between an upper limit or "rest" position and a lower limit or "home" position within a hollow column 50 supported on plate 44.

Another plate 54 carried by the uprights 18 and 20 supports the optics of our counter including the transmitting optics located within a housing 52.

A control panel 56 on the frame of the counter 16 supports one or more control pushbuttons 58. A suitable display 60 is provided on the panel.

Figure 5:
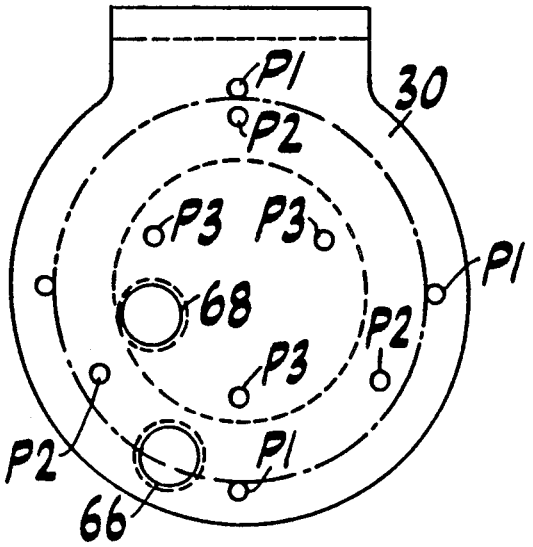
FIG. 5 is a top plan of the spindle support table of our CD counter illustrating the means for sensing the presence and size of a spindle placed on the table.
Figure 6:
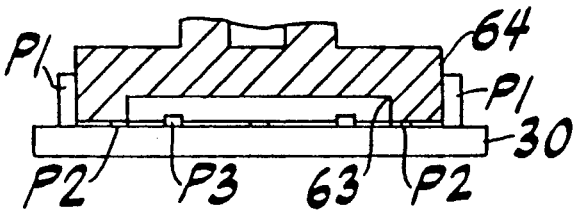
FIG. 6 is an elevation of the table shown in FIG. 5 with a fragmentary portion of one type of spindle shown in section.

Referring now to FIGS. 5 and 6, in the course of manufacture of compact discs spindles having bases of different diameters and of different configurations are employed to handle stacks of spindles. One type of spindle 62 illustrated in FIGS. 3 and 6 has a relatively large diameter base 64 formed with a recess 63. We provide the table 30 with a plurality of first locating pins P1 which locate base 64 by cooperation with the outer diameter thereof. When in position, the base 64 rests on spaced pins P2, the heights of which are such as to ensure that the spindle 62 is vertical when in position on table 30. It is to be noted that the pins P2 support the base 64 a short distance above the surface of table 30.

Figure 7:
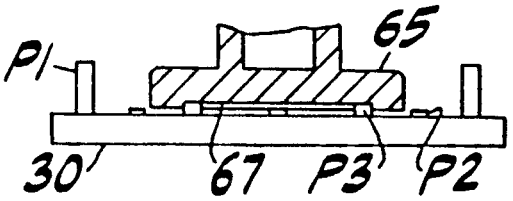
FIG. 7 is a view similar to FIG. 6 showing a fragmentary portion of another type of spindle in section.

Referring to FIG. 7, a second type of spindle has a base 65 of a smaller diameter than the base 64. We provide the table 30 with a plurality of spaced locating pins P3 which cooperate with the inner surface of a wall defining a recess 67 in base 65. When the base 65 is in position, the recess 67 rests on the pins P3 to ensure the verticality of the spindle. As is the case with base 64, when base 65 is in position it is supported a short distance above the surface of table 30. It will be seen that the recess 63 of base 64 can accommodate the pins P3 without interference.

In FIG. 5 we have indicated the outline of base 64 by the dot-dash line and have indicated the outline of the base 64 by the broken line. We provide the table 30 with a pair of proximity switches 66 and 68 located at different radial distances from the center of table 30. With base 64 in position, switch 66 is actuated by the portion of the base defining recess 63. When base 65 is in position, switch 68 is actuated by the portion of the base defining recess 67. To indicate the presence of base type 64 two switch combinations are possible. One combination is switch 66 "on" and switch 68 "off". The other is both switches 66 and 68 "on". To indicate the presence of base type 65 only one combination is acceptable, switch 66 "off" and switch 68 "on". In this way the apparatus is able to determine the size of the spindle. In addition, as will be pointed out hereinbelow, when a spindle of either size is placed on the table 30 a signal is given to start operation of the device.

Figure 4:
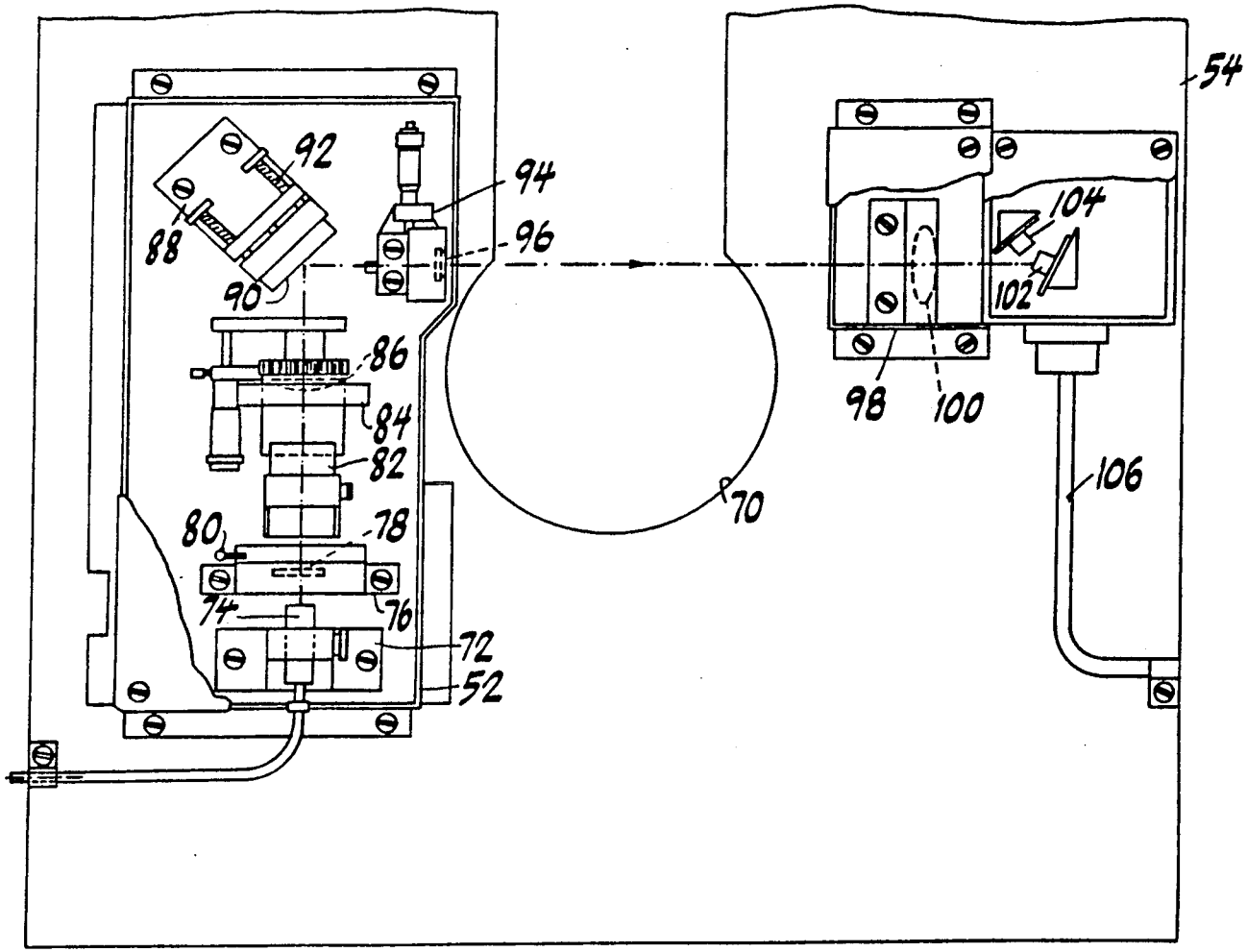
FIG. 4 is a top plan of the optical system of our compact disc counter with parts broken away.

Referring now to FIG. 4 which illustrates the optics of our apparatus, it will be seen that the optics support plate 54 is formed with an opening 70 which receives the cylindrical guide tube 50.

The housing 52, the top of which is broken away in FIG. 4, encloses a bracket 72 for supporting the laser 74 which emits a beam of light which passes through a quarter-wave retardation plate 78 supported on a bracket 76. An actuator 80 permits the crystaline optic axis of the retardation plate 78 to be rotated 45 degrees with respect to the input polarization plane of the incident laser beam to turn the linear polarized light from the laser 74 into circular polarized light. After passing through the plate 78, the light passes through a polarizing beam splitter 82 which splits the beam into two orthogonally polarized beams which are vertically displaced. It will be appreciated that the quarter-wave plate 78 changes the beam from linear polarized to circular polarized light so that there are elements of both a vertical and a horizontal polarization. Owing to that fact, the beam splitter 82 is able to split the beam into two vertically displaced beams.

After leaving the beam splitter 82, the vertically displaced beams pass through the first lens 86 of a beam reducing telescope. We mount the lens 86 in a linearly translatable slide 84 which permits the required adjustment to be made.

After leaving the lens 86 the vertically displaced beams impinge on a mirror 90 which reflects the beams through ninety degrees.

A bracket 88 carries screws 92 which permit adjustment of the mirror 90.

The vertically displaced beams emerging from the lens 86 are reflected by the mirror 90 to the second telescope lens 96 which is supported on a linearly translatable slide 94.

It will be appreciated that the mirror 90 renders the optics of the telescope comprising lenses 86 and 96 more compact. The telescope reduces the displacement of the split beams caused by the beam splitter to a specific amount which is made to correspond to the separation between two consecutive normal inter-disc spaces of a stack being scanned. The linearly translatable slides 84 and 94 permit the distance between the split beams to be adjusted to the required distance.

A housing 98 on plate 54 on the other side of the opening 70 from the transmitting optics, supports a lens 100 which takes light which is diffracted through the slits between adjacent discs of a stack and focuses it back to the original image of what it's looking at. That is, where each of the split beams passes through the space between a pair of adjacent discs, the lens 100 focuses the light down to two small lines corresponding to the light which passes through the two slits or gaps. It will be understood that a beam encountering the edge of a disc is refracted by the material of the disc to such an extent that it does not pass through lens 100 and so is not detected by detector 102.

We arrange a pair of detectors 102 and 104 in such a way as efficiently to convert the light focused by the lens 100 into an electrical signal. This signal is conducted away from the detecting system on a lead 106.

Figure 8:
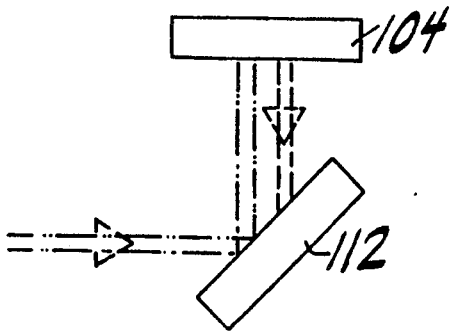
FIG. 8 is a diagrammatic view illustrating the detector arrangement of our compact disc counter.

Referring now to FIG. 8, we have shown the light passing from the lens 100 to the first detector 102 in dot-dash lines. As can be seen, the first detector is arranged at an angle of about 45 degrees to the incident light from the lens 100. A certain percentage of this incident light is reflected by detector 102 to the detector 104 as indicated by the dot-dot-dash lines. The second detector 104 is arranged at such an angle that the light reflected from the first detector to the second detector 104 is normal to the second detector. The arrangement of the second detector 104 is such that if any light should be reflected therefrom, the light will be reflected back to the first detector 112, as indicated by the broken lines in FIG. 8. The outputs of the two detectors 102 and 104 are combined. In this way, we efficiently convert the light from the lens 100 into an electrical signal.

As has been pointed out hereinabove, the spindle table 30 is mounted for movement between a rest or up position and a down or home position. When power is turned on, the system does not know the position of the table. As will be apparent from the description hereinbelow, we so arrange our system that when power is on the stepper motor 46 is energized to drive the table 30 down to its home position. Upon its arrival at the home position, a limit switch LS is actuated to to tell the control system to be described to reverse the motor to drive the table up to its rest position.

Referring now to FIGS. 9A through 9D, we have shown the relationship between the split beams 110 and 112 coming from lens 96 and the stack of discs 10 on a spindle 62 at various relative positions thereof. As has been pointed out hereinabove, the spacing between beams 110 and 112 is set to be equal to the spacing between a pair of adjacent gaps between successive discs. In the relative position of the beams 110 and 112 to the stack shown in FIG. 9A, the beams impinge on the respective edges of a pair of adjacent discs 10*q* and 10*r*. The beams are thus refracted by the material of the discs so that no light from the beams is focused by the lens 100 on the detector 102.

Figure 9A:
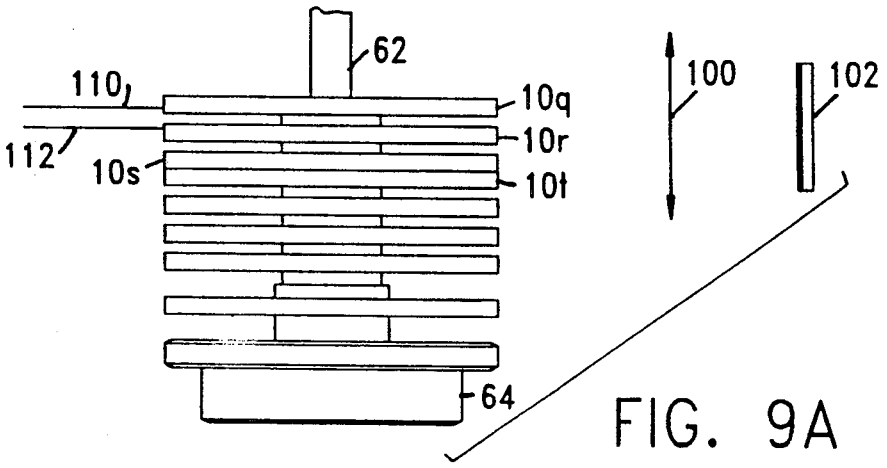
FIGS. 9A to 9D illustrate the operation of the optics our our counter at various relative positions of the stack of discs relative to the optics.
Figure 9B:
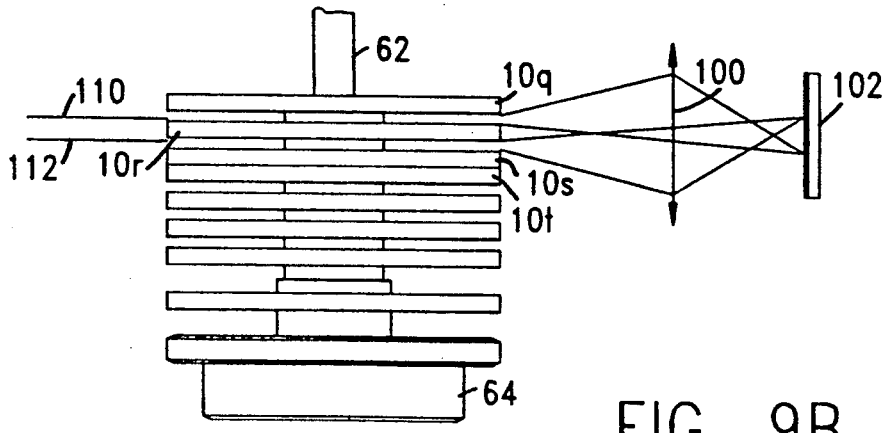

In the position of the beams 110 and 112 relative to the stack shown in FIG. 9B, beam 110 is diffracted as it passes through the space between discs 10*q* and 10*r*, while beam 112 is diffracted as it passes through the space between discs 10*r* and 10*s*. In this case, lens 100 focuses light from the respective beams onto the surface of detector 102 whereat the light would appear as a pair of vertically spaced horizontal lines.

Figure 9C:
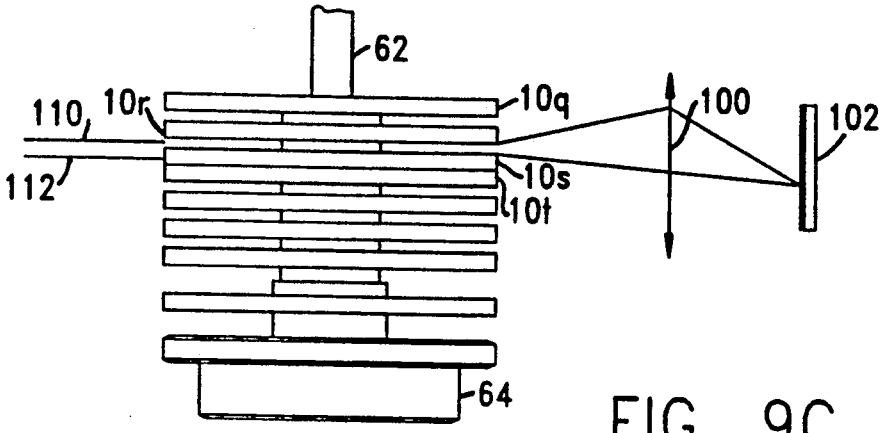

In the position of the beams 110 and 112 relative to the stack of discs illustrated in FIG. 9C, light from the beam 110 is diffracted as it passes through the space between discs 10*r* and 10*s*. This light is focused by lens 100 on the detector 102. Light from the beam 112, however, impinges on the edge of the disc 10*s* so as to be refracted to such an extent that it does not reach the lens 100.

Figure 9D:
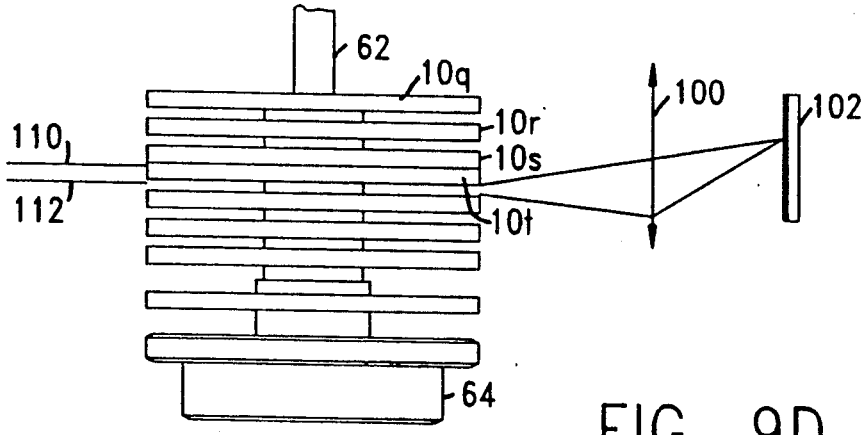

FIG. 9D shows a relative position of the beams 110 and 112 to the stack of discs 10 such that light from the upper beam 110 impinges on the edge of disc 10*t* so as to be refracted to such an extent that it does not reach the lens 100. Light from beam 112, however, passes through the space between disc 10*t* and the next lower disc so as to be focused on the detector 102.

Figure 10:
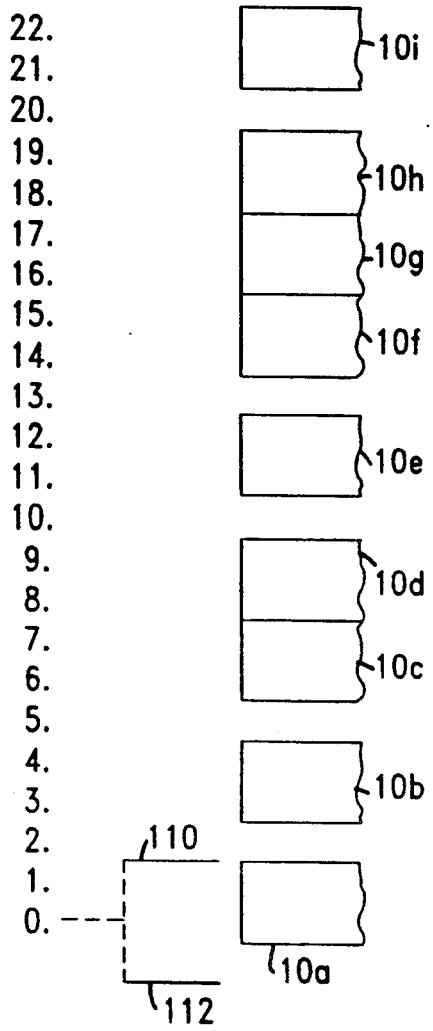
FIG. 10 is a diagrammatic view illustrating the mode of operation of our compact disc counter.
Figure 11:
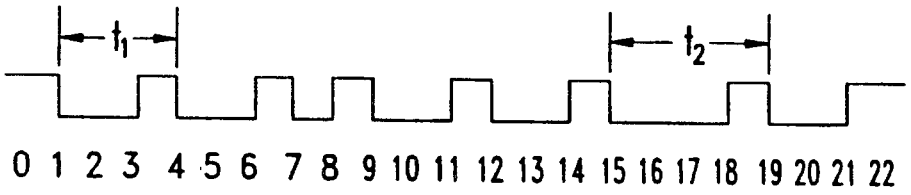
FIG. 11 is a plot further illustrating the mode of operation of our compact disc counter.

The operation of our counter in producing a correct count, even though for one reason or the other two or three consecutive discs do not have such an inter-disc spacing as permits light from the beam to pass therethrough, is illustrated in FIGS. 10 and 11. In the course of a counting operation, table 30 moves downwardly with respect to the stationary optics so that a stack of discs is first scanned from bottom to top thereof. Further, as will be explained hereinbelow, the counting operation is started when the upper beam 110 is in such a position relative to the stack that it registers with what should be a space between the lowest disc and the next to lowest disc.

In FIG. 10 we have indicated the successive discs scanned by the beams 110 and 112 from bottom to top of the stack by the reference characters 10*a* to 10*i*. We have indicated the fact that the beams move in unison by the vertical broken line and have indicated the vertical position of the beams relative to the stack of discs 10*a* to 10*i* by the horizontal broken line. We have, moreover, indicated twenty-two relative positions of the pair of beams 110 and 112 with reference to the stack of discs 10*a* to 10*i*.

In FIG. 11 we have indicated the wave form produced by the output of the detectors 102 and 104 along a horizontal axis as the stack moves relative to the detectors through the positions zero through 22. As can be seen with reference to FIGS. 10 and 11, at the start of a count as the pair of beams 110 and 112 move from position zero to position 1, beam 110 traverses the space between discs 10*a* and 10*b*. As the beams move relative to the stack from position 1 into position 2, beams 110 and 112 respectively impinge on the edges of discs 10*b* and 10*a* so that no output is produced. The result is a square pulse between positions zero and 1. The next pulse occurs from position 3 to position 4. Between positions 4 and 5 and positions 5 and 6, the beams impinge on disc edges. However, as the beams move from position 6 to position 7, beam 112 passes through the space between discs 10*b* and 10*c* to produce an output until the pulse is terminated upon movement of the beams into position 7.

The beams continue to impinge on edges until they enter position 8 at which time beam 110 passes through the space between discs 10*d* and 10*e* to cause a pulse to be produced and which pulse terminates as the beams comes into position 9.

From the explanation just given, it will readily be apparent that we have produced four pulses indicating the count of four discs 10*a* through 10*d* even though there exists no space between the discs 10*c* and 10*d*.

Continuing as the two beams 110 and 112 move together through positions 10 through 15, two more pulses will be produced. However owing to the fact that three consecutive discs 10*f*, 10*g* and 10*h* have no inter-disc spacing, the next pulse will not be produced until beam 110 passes through the space between discs 10*h* and 10*i* as the two beams move from position 18 to position 19. The final pulse will be produced when the beams move from position 21 to position 22.

From the explanation just given, it will be seen that while there are nine discs in the stack shown in FIG. 10, FIG. 11 shows only eight pulses. It will be appreciated that this is owing to the presence of the three discs 10*f*, 10*g* and 10*h* which have no inter-disc spacing. In our system we have arranged to obviate this inaccuracy. We accomplish this result by measuring the time between the trailing edges of successive pulses and adding a count of two if the time exceeds a predetermined time. For example, as can be seen by reference to FIG. 11, the normal time between the occurrence of the trailing edges of successive pulses is $t_1$. However, the time $t_2$ between the pulse occurring between positions 18 and 19 is appreciably greater than $t_1$. We compare the time between the trailing edges of successive pulses with a time $t_r$ which is greater than $t_1$ but less than $t_2$. When the measured time between trailing edges is greater than $t_r$, we add a count of 2. Thus, the pulse occurring between positions 18 and 19 produces a count of 2 for an overall count of 9 which is the correct count.

From the preceding explanation, it will readily be seen that our system accounts for both 2 and 3 successive discs which have no inter-disc spacing. It will further be appreciated that the possibility of four successive discs having no inter-disc spacing is relatively remote.

Figure 12:
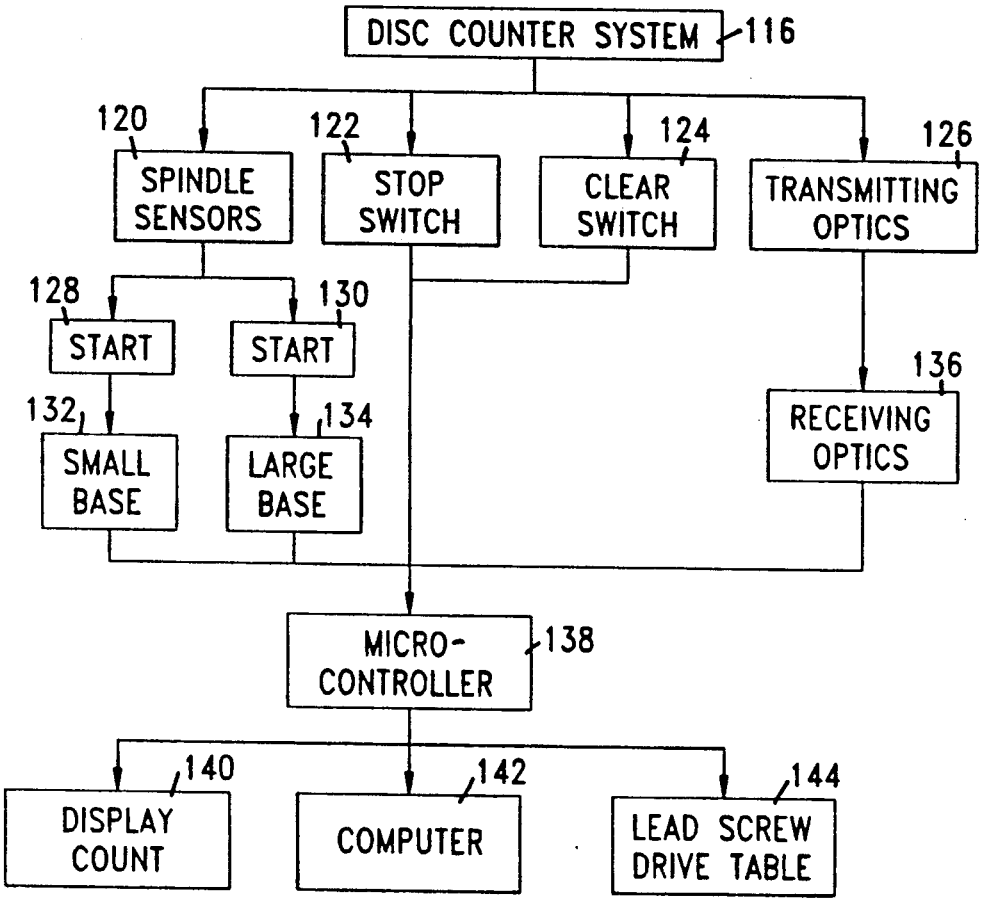
FIG. 12 is a flow chart illustrating the relationship between the various components of our system.

Referring now to FIG. 12, we have shown a flow chart of the general arrangement of our disc counter system indicated by the block 116. The system includes the spindle sensors 120 described hereinabove, a stop switch indicated by block 122, a clear switch indicated by block 124 and transmitting optics indicated by block 126. As has been explained hereinabove, the spindle sensors each provide a start signal indicated by blocks 128 and 130 and a small base or a large base indication designated by blocks 132 and 134 in FIG. 8. The transmitting optics 126 provide count signals to the receiving optics 136 All of the signals indicated by blocks 128, 130, 132, 134 and 136 are fed to the microcontroller 138 which is coupled to the display count indicated by block 140, the computer indicated by block 142 and the lead screw drive control indicated by block 144.

Figure 13:
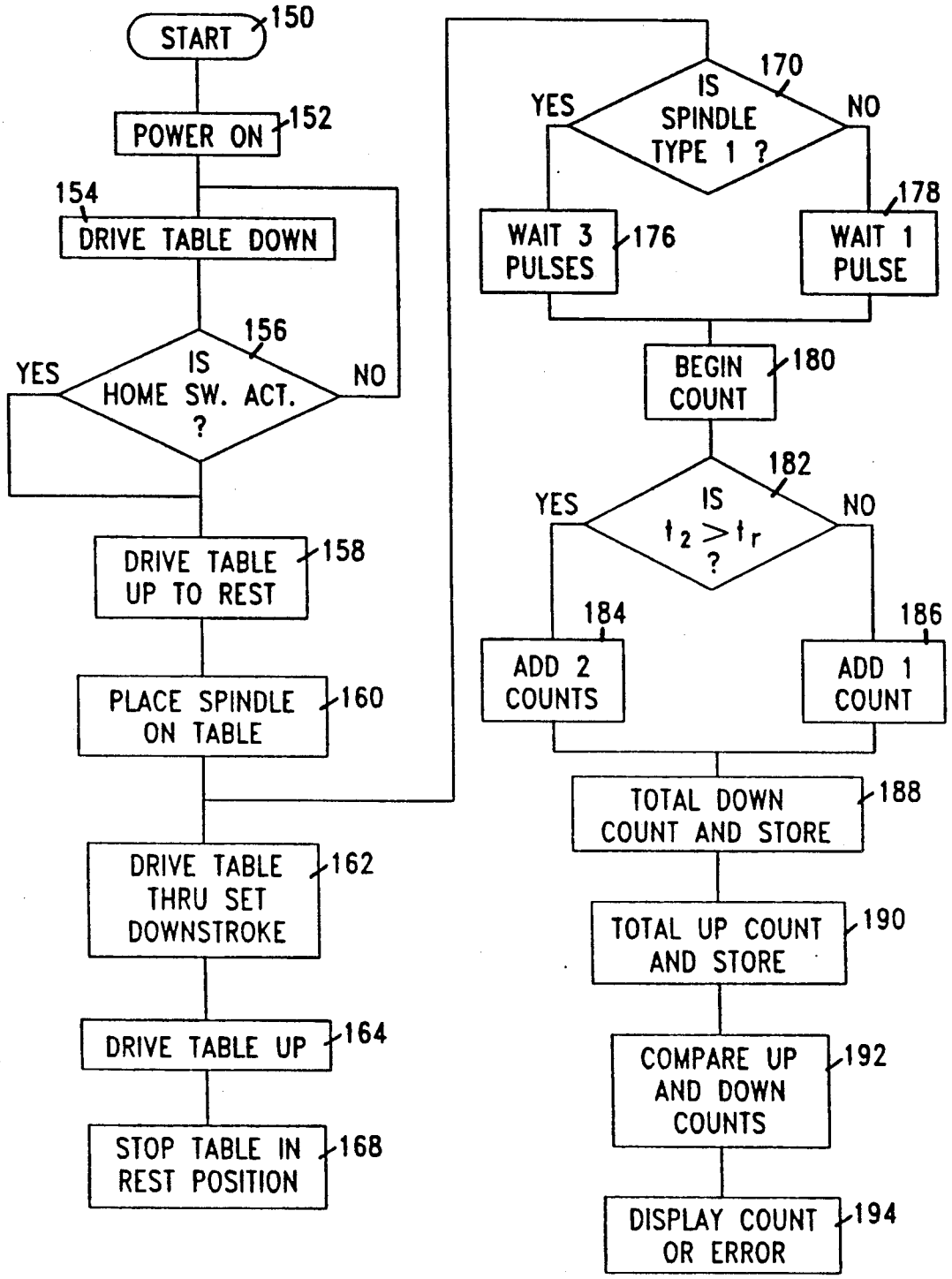
FIG. 13 is a flow chart illustrating the sequence of steps carried out in operation of our compact disc counter.

Referring now to FIG. 13, we have shown a simplified and abbreviated flow chart illustrating the sequence of operations of our counter. From the start 150, power is turned on as indicated by 152. Since the computer does not know the location of the table 30 when power is turned on, upon power on the table is driven down as indicated at 154. Movement of the table continues down until the switch LS is actuated as indicated by 156. At this time, the computer directs the table 30 to move upwardly to its rest position as indicated by block 158. The counter is now ready for operation.

Next the operator places a spindle 62 on the table. As has been described hereinabove, pins properly locate the spindle base on the table and support it so that the spindle is vertical with the base slightly above the surface of the table. Further as is explained hereinabove, when a spindle is placed on the table one of the switches 66 or 68 is actuated. Whichever switch is actuated, a start signal is given which directs the computer to move the table downwardly through a preset stroke which is slightly longer than the height of the stack. This movement of the table is indicated by block 162. When the table has completed its down stroke, the computer directs it to move back up as indicated by the block 164 and the table stops in its rest position as indicated by block 168.

It will be remembered that the proximity switches 66 and 68 not only give a start signal but also indicate the type of spindle which has been placed on the table 30. The indication of the spindle type is given at 170. The indication of the spindle type lets the system know the time, after the table begins its downward movement, at which the disc count should begin. In the rest position, as shown in FIG. 3, before the table begins its downward movement both beams are below the spindle base. For a spindle of the type shown in FIG. 3, which we have identified as type 1, the system waits three pulses before beginning the disc count. This is owing to the fact that the beams encounter three gaps before encountering an inter-disc gap. The first of these gaps is between the table 30 and the base 64 owing to the presence of the supporting pins P2. The second gap is between an annular boss 72 of the spindle and a spacer 174. The third gap is between the spacer 174 and the lowest disc 10 of the stack on the spindle.

For the other type spindle, the beams only encounter one gap before encountering an inter-disc gap with the result that the system waits for only one pulse before beginning the count.

We have indicated the two waiting periods for the different types of spindles by blocks 176 and 178, after which the down count is begun at 180.

In the course of making the count, we continuously measure the time between the trailing edges of successive pulses and compare this time with a reference time. If the time is greater than the reference time, the pulse produced is counted as two pulses. This operation is indicated at 182 after which an addition of two counts is indicated at 184 and of a single count at 186.

It will be remembered that the counting operation takes place both as the table 30 moves downwardly from its rest position through the preset down stroke and also as the table moves upwardly from the end of the down stroke back to its rest position. Therefore, when the table 30 has completed its down stroke the down count is totaled and stored as indicated at 188. Then a second count is taken as the table executes its upward stroke. This up count is also totaled and stored as indicated at 190. The up count is then compared to the down count as indicated at 192. If the two counts are equal the count is displayed. If the two counts are not equal the error message "E1" is displayed. The disply step is indicated by block 194. When the table has moved upwardly through a distance equal to the height of the column, the count is stopped as indicated at 194.

It will be seen that we have accomplished the objects of our invention. We have provided a compact disc counter which overcomes the disadvantages of disc counters of the prior art. Our counter is relatively simple in construction and in operation. Our counter minimizes the possibility of producing an incorrect count. It readily accommodates disc spindles of different types.

It will be understood that certain features and subcombinations are of utility and may be employed without reference to other features and subcombinations. This is contemplated by and within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. Apparatus for counting articles disposed in a stack having a longitudinal axis with gaps normally therebetween including in combination means for producing a pair of beams of radiation, means for spacing said beams in the direction of said axis by a distance substantially equal to the distance between a pair of adjacent normal gaps of said articles of said stack and greater than the dimension of a normal gap in said direction, radiation detecting means, means for mounting said radiation detecting means in operative relation to said beam producing means and with a space therebetween, and means for moving a stack of articles relative to said beam producing means and said detecting means through said space in the direction of said stack axis and generally perpendicular to said beams to cause said beams to traverse said gaps whereby said detecting means produces a pulse each time a beam traverses a gap, and means responsive to said pulses for producing a count of the number of articles in said stack.

2. Apparatus as in claim 1 in which said articles are compact discs each having a body formed with a central boss and an outer portion such that said gaps are formed between said outer portions by said bosses of adjacent discs.

3. Apparatus as in claim 1 in which said radiation is light.

4. Apparatus as in claim 1 in which said radiation producing means comprises a laser.

5. Apparatus as in claim 1 in which said beam producing means and said detecting means are stationary.

6. Apparatus as in claim 1 in which said detecting means comprises a first detector with its radiation receiving surface disposed at an angle to said beams, a second detector oriented to receive radiation reflected from said first detector and to reflect radiation back to said first detector and means for adding the output of said first and second detectors.

7. Apparatus as in claim 1 in which said means responsive to said pulses include means for measuring the time between successive pulses produced by said detecting means and means for counting the second of said successive pulses as two pulses where said time exceeds a reference time.

8. Apparatus as in claim 1 including means for adjusting the spacing between said beams.

9. Apparatus as in claim 1 in which said beam-producing means comprises means for generating a laser beam, a quarter-wave plate for polarizing said laser beam, a beam splitter for splitting said polarized laser beam into two beams and a telescope for adjusting the spacing between said two beams.

10. Apparatus for counting compact discs, each of which is formed with a central boss and an outer portion, said discs being arranged in a stack on a vertical spindle having a base with normal gaps formed by said bosses between outer portions of adjacent discs including in combination means for forming a pair of beams of radiation, means for spacing said beams vertically by a distance substantially equal to the distance between a pair of adjacent normal gaps between discs and greater than the vertical extent of a normal gap of said stack, radiation detecting means, means for mounting said detecting means in operative relationship to said beam producing means and with a space therebetween, a support for receiving a spindle base, means for mounting said support for vertical movement of a stack carried by said spindle base along a path through said space between an upper rest position and a lower home position, said path being located relative to said beam producing means such that said beams scan said gaps at the outer portions of said discs, energizable means for driving said support, and means responsive to said detecting means for producing a count of the number of discs in said stack.

11. Apparatus as in claim 10 including a source of power for said energizable means, means for turning said power source on and off and control means responsive to turning on of said power for causing said energizable means to drive said support first to its home position and then to its rest position.

12. Apparatus as in claim 10 including means responsive to placing of a spindle on said support for energizing said energizable means.

13. Apparatus as in claim 10 for handling spindles of different types, said apparatus including means responsive to placing of a spindle on said support for indicating which type of spindle has been placed on the support.

14. Apparatus as in claim 10 in which said support is provided with means for ensuring the verticality of a spindle placed on said support.

15. Apparatus as in claim 10 for handling a spindle having a base with a bottom recess formed therein, said support being provided with a first set of locating pins for engaging the outer surface of the base to locate the base on said support and a second set of verticality ensuring pins on which said base rests.

16. Apparatus as in claim 10 for handling a spindle having a base with a bottom recess formed therein, said support being provided with a set of pins for engaging the inner surface of the wall of said recess to locate said base on said support, the upper surface of said recess resting on said pins to ensure the verticality of the spindle.

17. Apparatus as in claim 10 for alternative use with a first type spindle having a large diameter base with a bottom recess therein or a second type spindle having a smaller diameter base with a bottom recess therein, said support being provided with a first set of pins for engaging the outer surface of the first type spindle base to locate the base on the support, a second set of pins on which the first type spindle base rests to ensure the verticality of the first type spindle, and a third set of pins for engaging the inner surface of the wall of the second type spindle base recess to locate the spindle on the support and for engaging the top of the second type spindle recess to ensure the verticality of the second type spindle.

18. Apparatus as in claim 17 including spaced proximity switches associated respectively with the first and second type spindles for indicating which type of spindle is on the support.

19. Apparatus as in claim 18 including means responsive to said detecting means for producing a count as said stack passes through said space and means responsive to actuation of said proximity switches for activating said count producing means.

20. In apparatus for counting articles stacked with gaps therebetween by causing a radiation source and associated detecting means to scan said stack whereby said detecting means produces a pulse each time it receives radiation passing from said source through a gap, apparatus including means for counting said pulses, means for measuring the time between successive pulses, means for comparing said measured time with a reference, and means for counting the later of said successive pulses twice when said measured time exceeds said reference.

* * * * *